US010215537B2

(12) United States Patent
Ganor

(10) Patent No.: US 10,215,537 B2
(45) Date of Patent: Feb. 26, 2019

(54) MODULAR CERAMIC COMPOSITE ANTIBALLISTIC ARMOR

(71) Applicant: A. Jacob Ganor, Kowloon (HK)

(72) Inventor: A. Jacob Ganor, Kowloon (HK)

( * ) Notice: Subject to any disclaimer, the term of this patent is extended or adjusted under 35 U.S.C. 154(b) by 0 days.

(21) Appl. No.: 15/533,922

(22) PCT Filed: Dec. 8, 2015

(86) PCT No.: PCT/US2015/064549
§ 371 (c)(1),
(2) Date: Jun. 7, 2017

(87) PCT Pub. No.: WO2016/094440
PCT Pub. Date: Jun. 16, 2016

(65) Prior Publication Data

US 2017/0363393 A1 Dec. 21, 2017

Related U.S. Application Data

(60) Provisional application No. 62/088,775, filed on Dec. 8, 2014.

(51) Int. Cl.
*F41H 5/04* (2006.01)
*F41H 1/02* (2006.01)
*F41H 5/013* (2006.01)

(52) U.S. Cl.
CPC ..... *F41H 5/0428* (2013.01); *F41H 1/02* (2013.01); *F41H 5/013* (2013.01); *F41H 5/0421* (2013.01)

(58) Field of Classification Search
CPC ..... F41H 5/0428; F41H 5/013; F41H 5/0421; F41H 1/02
USPC ..... 89/36.02
See application file for complete search history.

(56) References Cited

U.S. PATENT DOCUMENTS 1,767,081 A * 6/1930 Korber ..... B44C 3/123 428/39
3,867,239 A * 2/1975 Alesi ..... F41H 5/0428 428/48
4,198,707 A * 4/1980 Haupt ..... F41H 5/0457 2/2.5
4,241,457 A * 12/1980 Klein ..... F41H 5/0464 2/2.5
4,483,020 A * 11/1984 Dunn ..... F41H 5/0428 2/2.5
5,185,195 A * 2/1993 Harpell ..... B32B 7/08 428/102
5,996,115 A * 12/1999 Mazelsky ..... F41H 1/02 2/2.5
6,737,158 B1 * 5/2004 Thompson ..... F41H 5/02 174/126.2

(Continued)

*Primary Examiner* — Samir Abdosh
(74) *Attorney, Agent, or Firm* — Jenei LLC

(57) ABSTRACT

The present invention provides for methods and compositions for lightweight composite antiballistic assemblies comprising interlocking ceramic plates or modules. The modules may be self-contained and include both ceramic and ductile elements. Alternatively, interlocking ceramic plates may be arrayed over a ductile backing layer of metal or antiballistic fiber or polymer. The ceramic elements may be enhanced with carbon nanotubes or other reinforcing nanomaterials. In one or more embodiments, the strike-face, or front-facing surface, of this assembly may feature a non-planar design to assist in defeating incoming projectiles.

17 Claims, 7 Drawing Sheets

(56) References Cited

U.S. PATENT DOCUMENTS

| | | | | |
|---|---|---|---|---|
| 7,793,579 | B1 * | 9/2010 | Lee | F41H 5/013 89/36.02 |
| 7,827,899 | B2 * | 11/2010 | Ravid | F41H 5/0457 2/2.5 |
| 8,096,223 | B1 * | 1/2012 | Andrews | F41H 5/0492 89/36.02 |
| 8,322,268 | B1 * | 12/2012 | Booher, Sr. | F41H 5/04 89/36.02 |
| 8,616,113 | B2 * | 12/2013 | Gallo | F41A 17/06 89/36.02 |
| 2011/0168003 | A1 * | 7/2011 | Kim | F41H 1/02 89/36.02 |

* cited by examiner

MODULAR CERAMIC COMPOSITE ANTIBALLISTIC ARMOR

CROSS-REFERENCE TO RELATED APPLICATIONS

The present Application for Patent claims priority to Provisional Application No. 62/088,775 entitled "CERAMIC COMPOSITE ANTIBALLISTIC ARMOR" filed 8 Dec. 2014, and assigned to the assignee hereof and hereby expressly incorporated by reference herein.

BACKGROUND OF THE INVENTION

1. Field of the Invention

The field of art disclosed herein pertains to armor materials, and more particularly for composite ceramic materials for ballistic protection.

2. Description of the Related Art

Military standard body armor plates are presently based on technologies that are many decades old. For example, monolithic boron carbide (B4C) or Silicon Carbide (SiC) plates over an Aramid backing layer are frequently used. Aramid is a type of polymer and includes the generic family of Kevlar and Nomex. Military standard ESAPI (Enhanced Small Arms Protective Insert) plates are relatively primitive, based on technologies that are many decades old. For example, monolithic boron carbide (B4C) or Silicon Carbide (SiC) plates over an Aramid backing layer are frequently used. Aramid is a type of polymer and includes the generic family of Kevlar and Nomex.

SUMMARY OF THE INVENTION

In one aspect, the present disclosure provides a lightweight composite antiballistic plate assembly including a ceramic plate comprising replaceable and interlocking ceramic modules formed from hot-pressed or spark-plasma sintered ceramic powders fortified with nanotubes. A backing layer includes a ductile element, which may be a polymer such as ultra-high-molecular-weight polyethylene (UHMWPE) or a metal. The ductile backing material may also contain nanomaterial reinforcement. The modules may be encapsulated in synthetic prepregs, and in shock and abrasion-resistant materials.

In an additional aspect, the present innovation provides a method of forming a lightweight composite antiballistic plate assembly. In one embodiment, the method includes dispersing nanomaterials into a ceramic slurry to form a fortified ceramic slurry. The method includes drying the ceramic-nanomaterial slurry into a powder. The method then includes molding and sintering the fortified ceramic slurry into interlocking ceramic pieces. The method then includes either assembling the interlocking ceramic pieces into a ceramic plate, and then assembling those plates into a final configuration, between a ductile backing layer and a shock-resistant outer shell—or assembling those ceramic pieces into self-contained modules, which include a ductile backing layer and a shock-resistant outer shell, and then assembling those modules into a final configuration in an array.

These and other features are explained more fully in the embodiments illustrated below. It should be understood that in general the features of one embodiment also may be used in combination with features of another embodiment and that the embodiments are not intended to limit the scope of the invention.

BRIEF DESCRIPTION OF THE DRAWINGS

The various exemplary embodiments of the present invention, which will become more apparent as the description proceeds, are described in the following detailed description in conjunction with the accompanying drawings, in which.

DETAILED DESCRIPTION

Research has discovered that the perforation of ceramic armor systems occurs in three overall stages: (1) shattering; (2) erosion; and (3) catching. The present innovation addresses these perforation effects. During the shattering phase, the penetrator fractures and breaks on the surface of the ceramic plate.

The high hardness and compressive strength of the ceramic can outmatch the loading produced by penetrator impact, and the penetrator material flows and shatters. During stage two, the ceramic material is cracking, but can still contribute to defeat of the penetrator core through erosion mechanisms. In the last stage, the system as a whole contributes to defeat of the projectile via momentum-transfer mechanics.

High-energy projectiles can also be defeated by inclining the target at a certain angle to the projectile's line of flight. In an early example, a perforated armor plate was first used in Israeli tank armor. The perforated armor plate included evenly drilled holes in a high hardness steel plate. The diameter of the holes and their spacing were designed so that incoming projectiles always impact an area, which includes some part of a hole. The asymmetric forces on the projectile either break its hard core or deflect its path considerably. Certain embodiments of the present innovation include geometries to divert projectiles.

In one embodiment, the geometries comprise one or more geometrical shapes such as circles, squares, triangles, rectangles, hexagons, octagons or a combination thereof.

Figure 1:
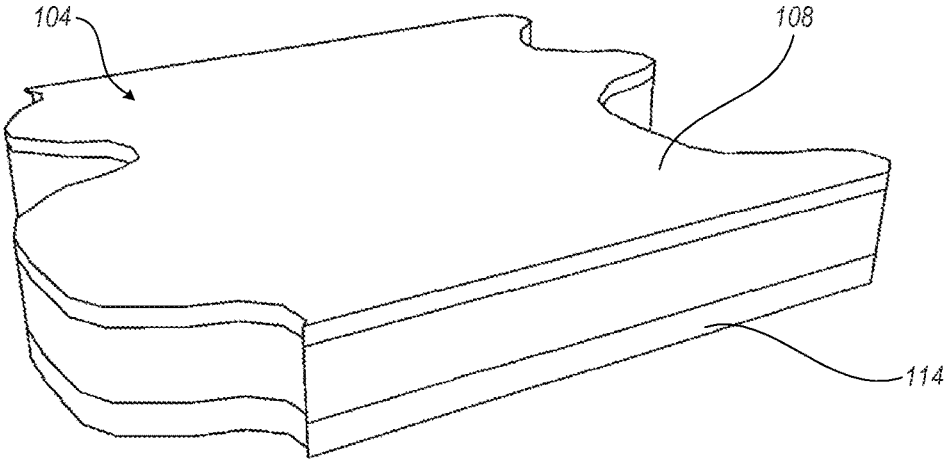
FIG. 1 illustrates a perspective view of a lightweight composite ceramic module according to one or more embodiments.
Figure 2:
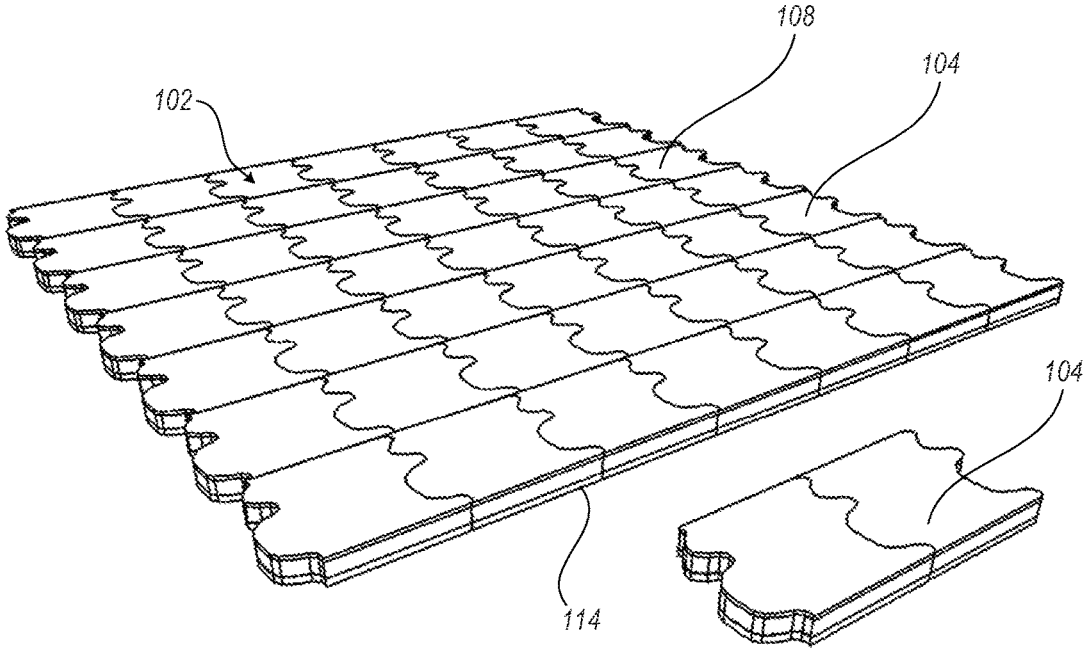
FIG. 2 illustrates a perspective view of a lightweight composite antiballistic plate assembly formed of the lightweight composite ceramic modules of FIG. 1, according to one or more embodiments.

FIGS. 1-2 illustrate a lightweight composite antiballistic plate assembly 100 that includes a ceramic plate 102 (FIG. 2) of replaceable and interlocking ceramic modules 104. In one embodiment the ceramic modules 104 are formed from hot-pressed ceramic slurry fortified with nanotubes made from carbon, boron nitride, silicon carbide, and/or tungsten disulfide. This can be done by dispersing nanotubes into a wet ceramic slurry in a high-shear disperser or ball-mill, and drying the wet slurry after processing.

In one embodiment, the nanotubes can be at approximately 0.5-7.5% w/v (weight to volume mass concentration.). Nanotube-ceramic composites should have greater toughness and resilience than plain unenhanced ceramics. The molded and sintered ceramic composite can be made primarily of boron carbide (B4C), silicon carbide (SiC), aluminum magnesium boride, sintered polycrystalline cubic boron nitride, titanium diboride, titanium carbide, tungsten boride, zirconium boride, boron suboxide, calcium hexaboride, alumina, and mixtures thereof. The ceramic modules 104 can have a nonplanar strike face 108 to deflect a ballistic projectile that is directed in frontal direction.

In one embodiment, the ceramic component is made with carbide, oxide, or nitride based materials. For example aluminum oxide, boron carbide, silicon carbide, boron nitride, boron suboxide, and silicon nitride.

In another embodiment, the ceramic element is embedded in a polymeric structure that can include reinforcing fibers like carbon, aramid or e-glass.

In one embodiment, the ceramic component additionally includes sintering aids. In one embodiment, these sintering aids are oxides such as Al2O3, ZrO2, BeO, and TiO2. In another embodiment, the sintering aids are metals selected from the group consisting of Al, Ti, Ni, Mo, Co, Mg, Be, Zr, and Fe. In either case, these sintering aids can be present in quantities ranging from 0-10% by volume.

The lightweight composite antiballistic plate assembly 100 can be a three-layered system that also includes a backing layer 114 that is generally featureless and flat and can be made from high-elasticity metal, metal glass, or polymer such as Kevlar and ultra-high-molecular-weight polyethylene (UHMWPE). In one embodiment, it is comprised of ultra-high-molecular-weight polyethylene (UHMWPE) reinforced with carbon nanotubes.

The composite antiballistic plate assembly 100 has either a flat, curved or multicurved shape, with a thickness of 2.0-17.5 mm. In one embodiment, the layers of the composite antiballistic plate assembly 100 are bonded using a bonding adhesive or bonding agent. Such adhesive may comprise an epoxy resin, a polyester resin, a polyurethane resin or a vinyl ester resin. In one embodiment, suitable bonding adhesives are epoxy glues as 3M structural adhesive film AF163-2, Hysol EA 9628, or ceramic glue as AREMCO adhesive 503, 552 or 516.

In another embodiment the ballistic resistant article according to the invention comprises a further layer, herein after referred to as further sheet, of material selected from the group consisting of ceramic, metal, aluminum, magnesium titanium, nickel, chromium, and iron, or their alloys, glass and graphite, or combinations thereof. The further sheet of material may be incorporated in the stack and formed with the stack. It is also possible to use the further sheet of material as a mold part, provided it has sufficient stiffness.

A particularly preferred material for the further sheet is metal. In such case the metal in the metal sheet preferably has a melting point of at least 350° C., more preferably at least 500° C., most preferably at least 600° C. Suitable metals include aluminum, magnesium, titanium, copper, nickel, chromium, beryllium, iron and copper including their alloys as e.g., steel and stainless steel and alloys of aluminum with magnesium (so-called aluminum 5000 series), and alloys of aluminum with zinc and magnesium or with zinc, magnesium and copper (generally called aluminum 7000 series). In the alloys, the amount of e.g. aluminum, magnesium, titanium and iron preferably is at least 50 wt. %. Preferred metal sheets comprising aluminum, magnesium, titanium, nickel, chromium, beryllium, iron including their alloys. More preferably, the metal sheet is based on aluminum, magnesium, titanium, nickel, chromium, iron and their alloys. This results in a light antiballistic article with a good durability. Even more preferably, the metal sheet has a hardness of over 200 HV. Most preferably the metal sheet is based on aluminum, magnesium, titanium, and their alloys.

In one embodiment, the backing layer 114 has a thickness ranging between 0.1 and 8.0 mm and is in the form of metallic sheet, metallic fabric, or metallic grid/net. In one embodiment, the backing layer 114 is selected from the group consisting of E-glass, S-glass, aramid ballistic fabrics, ultra-high molecular weight polyethylene (UHMWPE), PPTA (p-phenylene terepthalamide), graphite or combinations thereof, high strength aluminum alloys, high strength magnesium alloys, high strength steel alloys, high strength titanium alloys or combinations thereof. In one embodiment, the backing layer 114 is selected from the group consisting of metals or metallic alloys such as high strength aluminum alloys, high strength magnesium alloys, high strength steel alloys or high strength titanium alloys. In another embodiment, the metal or metallic alloy is selected from high strength aluminum alloy as AL7075/AL6061/AL2024 alloys, high strength magnesium alloys as AZ90/AZ91, high strength steel alloys as SAE 4340/SAE 4140, high strength titanium alloys as Ti-6Al-4V or other metallic alloys such as brass, bronze, nickel alloys, tin alloys, beryllium alloys, etc.

In another embodiment, the backing layer 114 is made of composite material fabrics woven roving or UD (unidirectional) E-glass or S-glass fabrics, aramid ballistic fabrics, ultra-high molecular weight polyethylene fabrics (UHMWPE), graphite fabrics, or a combination thereof. Aramid ballistic fabric suitable as backing material is for instance one of the following commercial fabrics: Twaron, manufactured by Teijin Twaron in Germany/The Netherlands and Kevlar 29 manufactured by DuPont USA. UHMWPE fabric suitable as backing material can be one of the following commercial fabrics: Spectra Shields PCR, manufactured by Honeywell International, Inc. of Colonial Heights, Va. or Dyneema HB2/HB26/HB50 manufactured by DSM USA or DSM of the Netherlands.

In another embodiment of the present invention, the antiballistic article is encapsulated in an outer shell of antiballistic material with curable resin selected from epoxy (e.g., FM73 of Cytec, EA 9628 & EA 9309 of Hysol/Henkel, F161 of HEXCEL, Araldite 2015 of Huntsman), polyester, phenolic (e.g., HEXCEL F120 or HT93, or polyurethane resin (e.g., RENCAST FC 52 (Vantico), Biresin U1305 or SIKAFLEX 201 of Sika Deutschland) or thermoplastic resin (e.g. polyolefin, polyester, polyurethane, PVC and other vinyl thermoplastic resins). This outer shell can be selected from aramid fabric, UHMWPE, E-glass, S-glass, graphite fabric, or combination hybrids and can have the form of a plain weave cloth, a unidirectional tape, filament winding, or braiding. In one or more embodiments of the present invention, this outer shell is between 3-12 layers thick.

In accordance with another embodiment of the present invention, the antiballistic article may further comprise an anti-shock layer made of foam, polyurethane, polyurea, or rubber material bonded to the faces of the antiballistic article as is commonly done in practice to defend the ceramic plate from breaking, and to reduce armor spilling from defeated projectiles. The antiballistic article may further comprise an antiballistic backing made of metals such as aluminum alloys, titanium alloys, steel alloys, magnesium alloys or a combination thereof.

In one embodiment the outer shell comprises at least one layer of multifilament yarn. As used herein, the term "multifilament yarns", also referred to below simply as "yarns", refers to linear structures consisting of two or more filaments of in principle endless length. Such multifilaments are known to the skilled person. There is in principle no restriction on the number of individual filaments comprising a multifilament yarn. A multifilament generally comprises between 10 and 500 filaments, and frequently between 50 and 300 filaments. Multifilament yarns for anti ballistic applications are usually yarns from the ultra high molecular weight polyethylene (UHMWPE) or aramid (poly paraphenylene terephthalamide) type, however, also other high performance fibers as mentioned below can be applied. The layers of multifilament yarns can consist of the family of para-aramid multifilament yarns, known and sold under the trade names like e.g. Twaron, Kevlar, Heracron, Pycap or Artec, high strength polyethylene multifilament yarns like Dyneema, Spectra or other various UHMWPE multifilament yarns, high strength glass multifilament yarns known as E-glass, R-glass and S-glass. Furthermore other high performance multifilament yarns like carbon multifilament yarns, HS basalt multifilament yarns; polybenzoxazole (PBZO) multifilament yarns, polybenzothiazole (PBZT) multifilament yarns, HDPA multifilament yarns, UHMWPA multifilament yarns, UHMWPP multifilament yarns, HDPP multifilament yarns, HDPE multifilament yarns etc.; basically any multifilament high strength yarn with a strength above 60 cN/tex as they are in use in this anti--ballistic and "life protection" industry or composite industry can be applied, in single or multiple layers.

Ultra-high-molecular-weight polyethylene (UHMWPE, UHMW) is a subset of the thermoplastic polyethylene. Also known as high-modulus polyethylene, (HMPE), or high-performance polyethylene (HPPE), it has extremely long chains, with a molecular mass usually between 2 and 6 million unified atomic mass unit (symbol: u). The longer chain serves to transfer load more effectively to the polymer backbone by strengthening intermolecular interactions. This longer chain thus results in a very tough material, with the highest impact strength of any thermoplastic presently made. UHMWPE is odorless, tasteless, and nontoxic. It is highly resistant to corrosive chemicals except oxidizing acids; has extremely low moisture absorption and a very low coefficient of friction; is self-lubricating; and is highly resistant to abrasion, in some forms being fifteen (15) times more resistant to abrasion than carbon steel. Its coefficient of friction is significantly lower than that of nylon and acetal, and is comparable to that of polytetrafluoroethylene (PTFE), commonly referred to as TEFLON®. However, UHMWPE has better abrasion resistance than PTFE.

Figure 3:
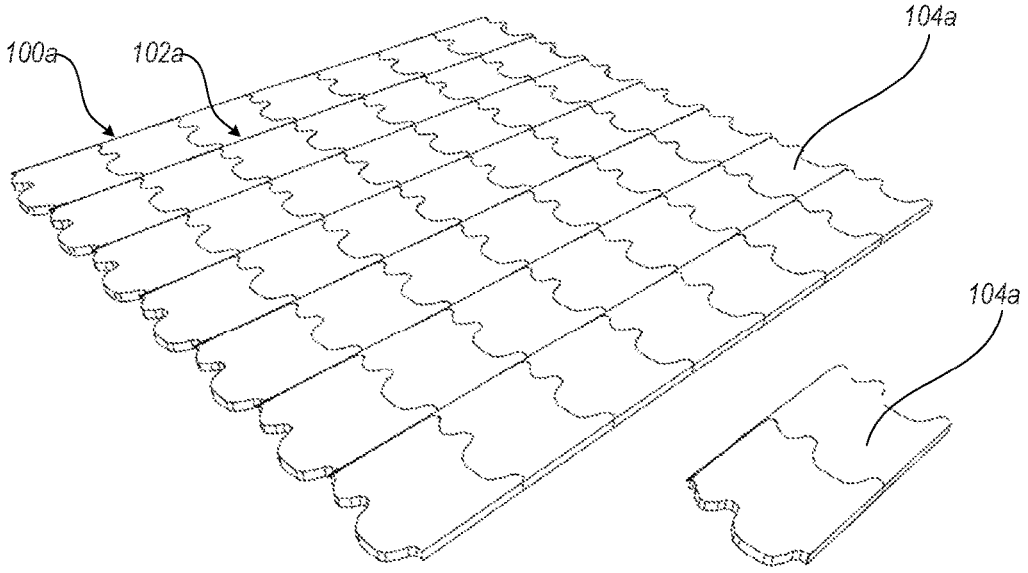
FIG. 3 illustrates a perspective view of a single layer composite antiballistic plate assembly formed of single layer lightweight composite ceramic modules, according to one or more embodiments

FIG. 3 illustrates an example single-layer lightweight composite antiballistic plate assembly 100*a* that includes a ceramic plate 102*a* of replaceable and interlocking ceramic modules 104*a*. In one embodiment the ceramic modules 104 are formed from hot-pressed ceramic slurry fortified with nanotubes made from carbon, boron nitride, silicon carbide, and/or tungsten disulfide. This can be done by dispersing nanotubes into a wet ceramic slurry in a high-shear disperser or ball-mill, and drying the wet slurry after processing. The ceramic plate 102*a* can provide sufficient ballistic protection without an added strike face or underlayer.

Figure 4:
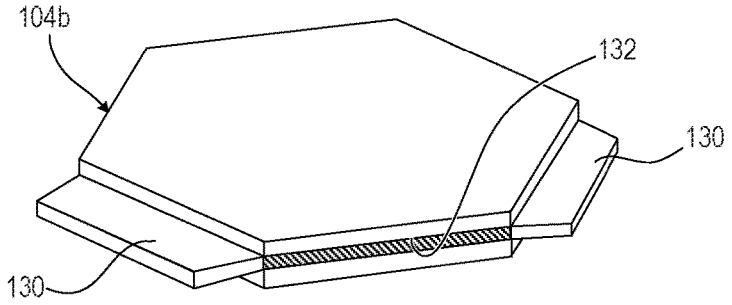
FIG. 4 illustrates a perspective view of a hexagonal ceramic module, according to one or more embodiments.
Figure 5:
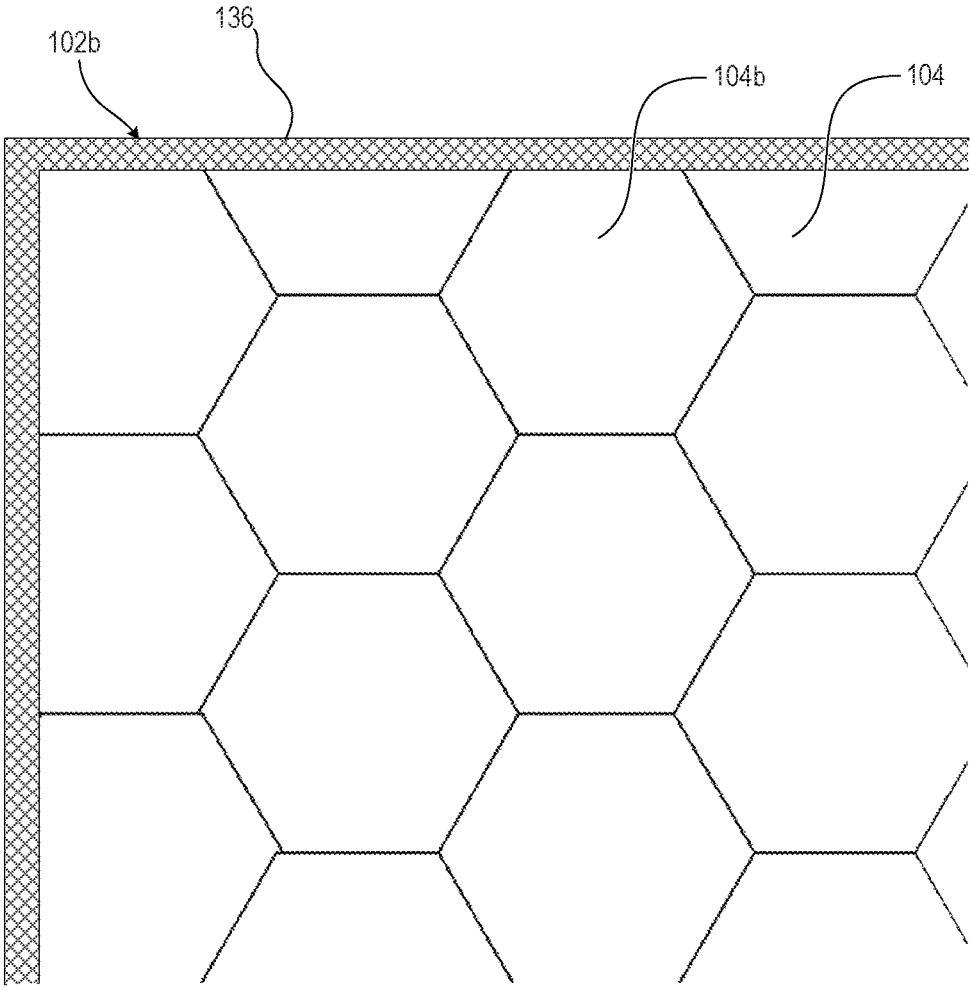
FIG. 5 illustrates a front view of an example ceramic plate formed of hexagonal ceramic modules of FIG. 4, according to one or more embodiments.

FIGS. 4-5 illustrate a hexagonal ceramic module 104*b*, according to one or more embodiments to form an interlocked outer layer 102*a* such as B4C based. Each hexagonal ceramic module 104*b* can include three tabs 130 separated by three slots 132 for interlocking. The interlocking can improve multi-hit performance and overall durability. Boron carbide is the hardest commonly available ballistic material, but it is relatively brittle. When boron carbide gets hit, large cracks and fractures form, and these can dramatically reduce multi-hit performance. Interlocked units can arrest crack propagation, and prevent one fracture from ruining the entire ballistic plate.

In addition, the broken ceramic modules 104*b* can be replaced for economical repair. A modular system of interlocking plates can make a ceramic armor system easier to repair and service. Current individual armor systems are basically comprised of two monolithic plates: A front-plate, and a back-plate. These plates are bonded to each other, and are completely destroyed upon ballistic contact. They are also surprisingly fragile, so they're often destroyed and rendered useless if handled improperly. A system of 6-8 interlocking plates would make repair possible. Individual cracked or damaged plates can be replaced, and intact ones can be re-used or recycled. The edges of this grid are held in a frame 136, which may be coated in a shock-resistant material to prevent handling damage.

Figure 6:
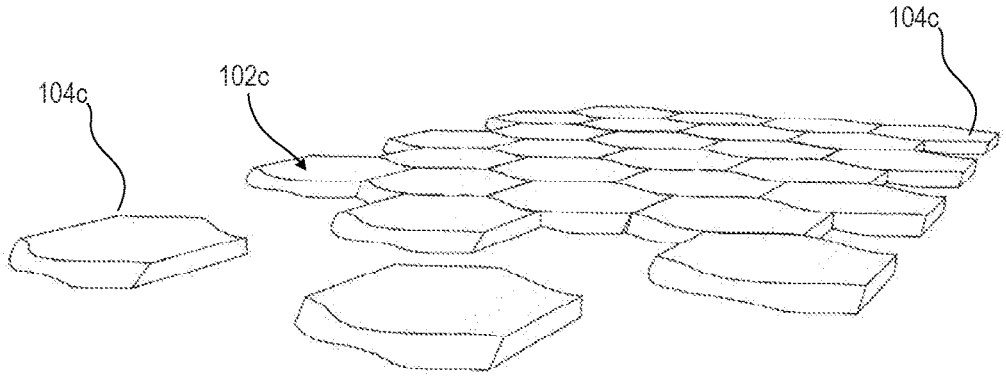
FIG. 6 illustrates a partially disassembled front left perspective view of a second example ceramic plate, according to one or more embodiments.
Figure 7:
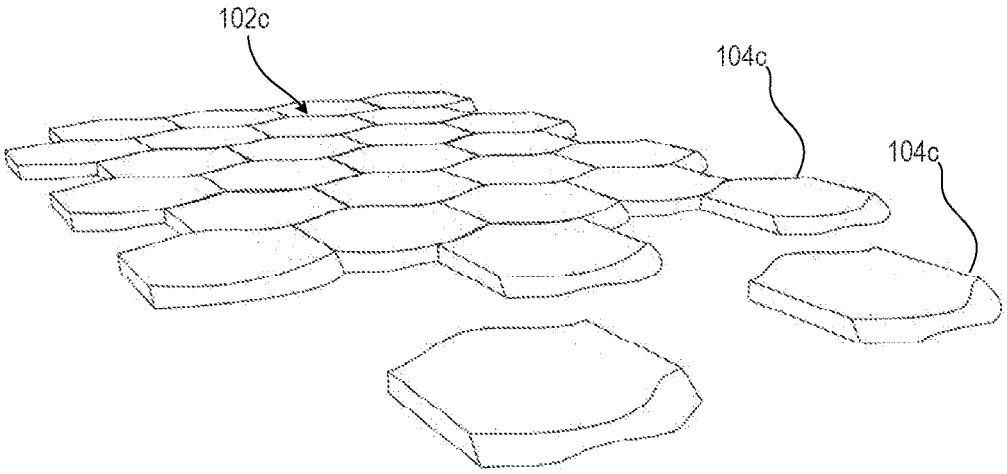
FIG. 7 illustrates a partially disassembled front perspective view of the second example ceramic plate of FIG. 6, according to one or more embodiments.
Figure 8:
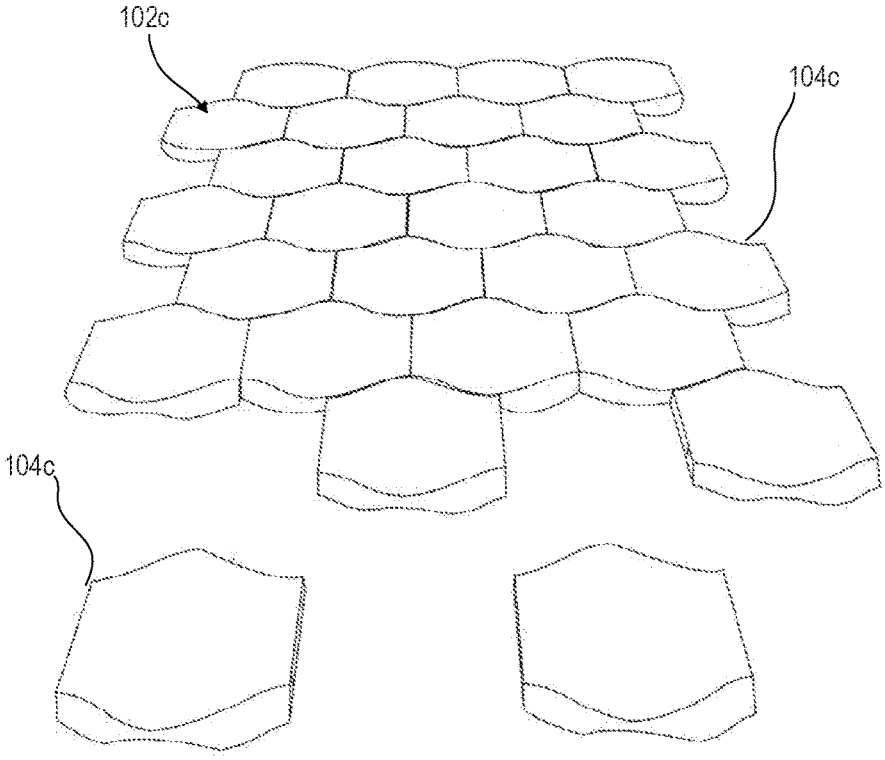
FIG. 8 illustrates a partially disassembled front left perspective view of the second example ceramic plate of FIG. 6, according to one or more embodiments.
Figure 9:
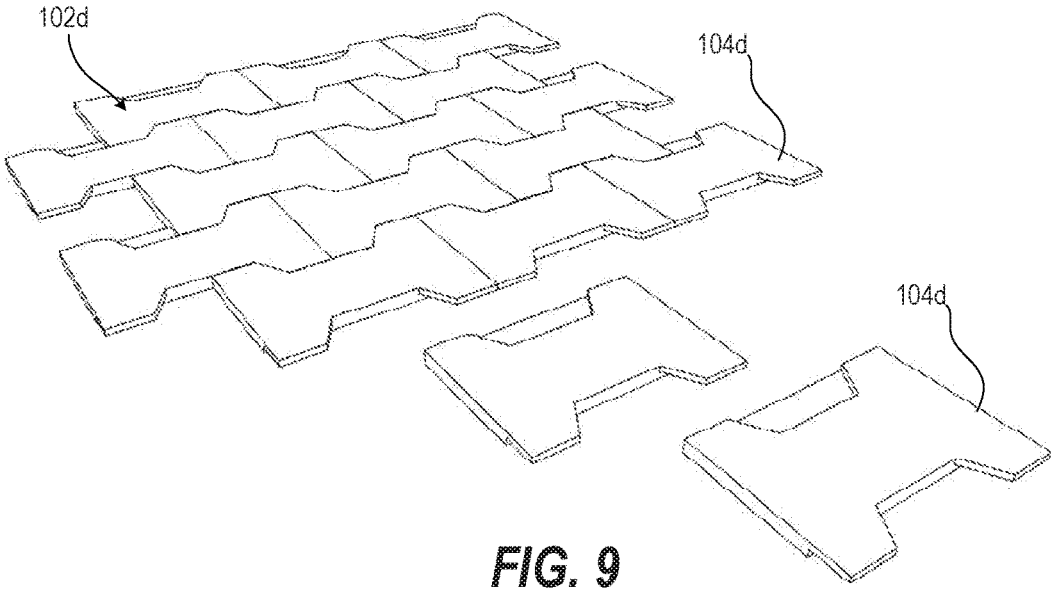
FIG. 9 illustrates a partially disassembled front left perspective view of a third example ceramic plate formed of osteomorphic ceramic modules having another topological interlocking the shape, according to one or more embodiments.
Figure 10:
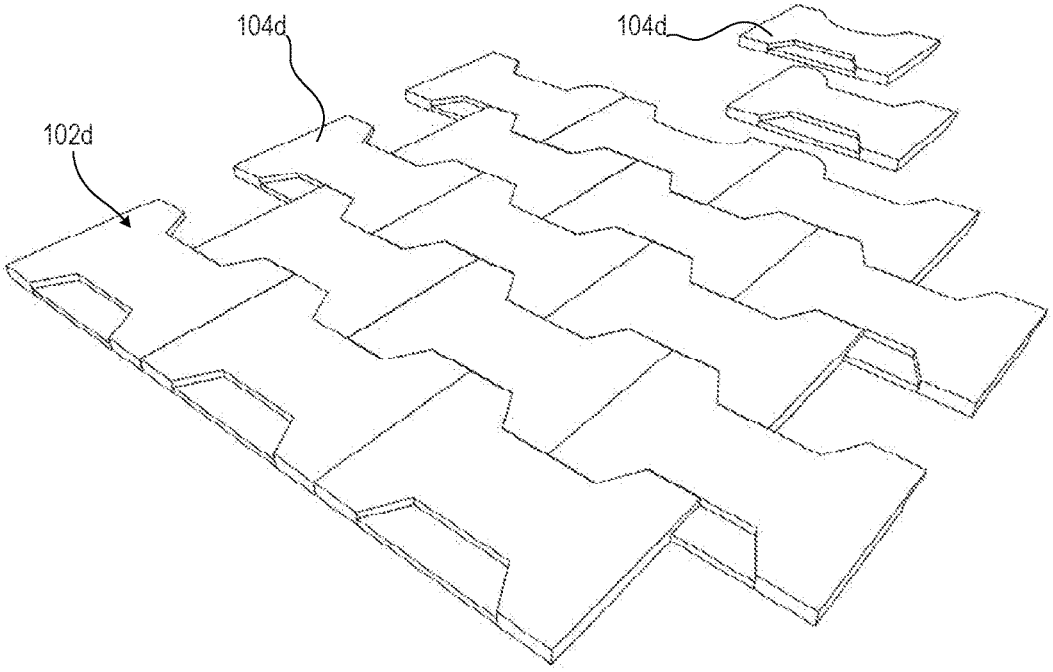
FIG. 10 illustrates a partially disassembled back left perspective view of the third example ceramic plate of FIG. 9 formed of osteomorphic ceramic modules having the other topological interlocking tile shape, according to one or more embodiments.
Figure 11:
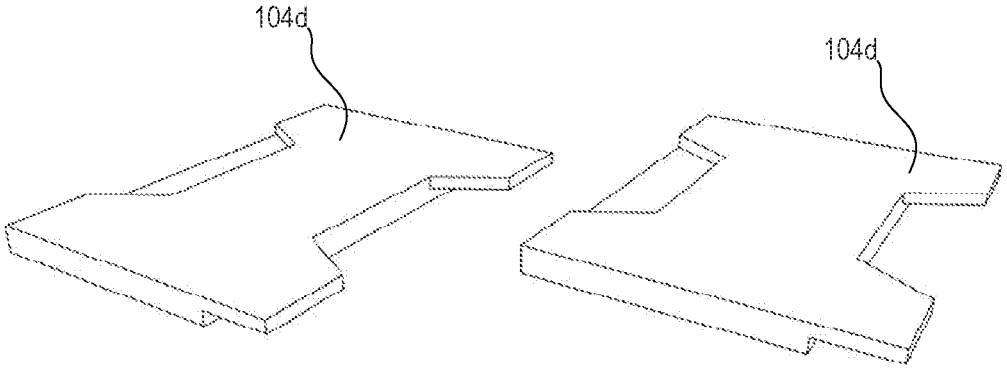
FIG. 11 illustrates a left perspective view of two osteomorphic ceramic modules having the third topological interlocking tile shape of FIG. 9, according to one or more embodiments.
Figure 12:
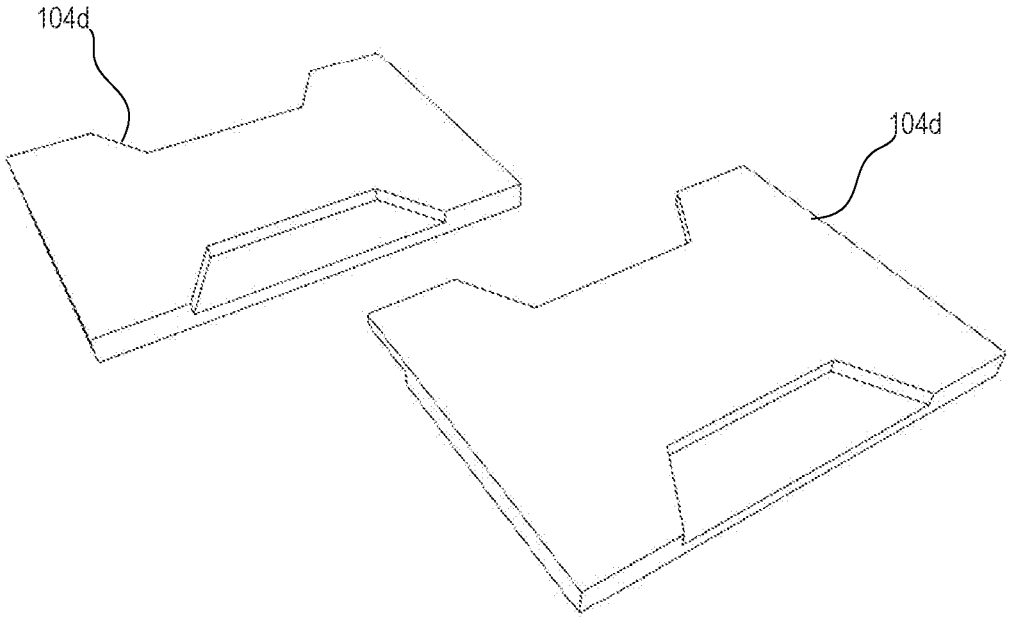
FIG. 12 illustrates a front left perspective view of the two osteomorphic ceramic modules having the third topological interlocking tile shape of FIG. 11, according to one or more embodiments.

FIGS. 6-8 illustrate another example ceramic plate 102*c* formed of osteomorphic ceramic modules 104*c* having a first topological interlocking shape, according to one or more embodiments.

FIGS. 9-12 illustrate another example ceramic plate 102*d* formed of osteomorphic ceramic modules 104*d* having a third topological interlocking shape, according to one or more embodiments.

It must be noted that, as used in this specification and the appended claims, the singular forms "a," "an" and "the" include plural referents unless the content clearly dictates otherwise. Thus, for example, reference to a "colorant agent" includes two or more such agents.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

The entire disclosures of all applications, patents and publications cited herein, if any, are herein incorporated by reference. Reference to any prior art in this specification is not, and should not be taken as an acknowledgement or any form of suggestion that that prior art forms part of the common general knowledge in the field of endeavor in any country in the world.

The invention may also be said broadly to consist in the parts, elements and features referred to or indicated in the specification of the application, individually or collectively, in any or all combinations of two or more of the parts, elements or features.

Where in the foregoing description reference has been made to integers or components having known equivalents thereof, those integers are herein incorporated as if individually set forth.

As will be appreciated by one having ordinary skill in the art, the methods and compositions of the invention substantially reduce or eliminate the disadvantages and drawbacks associated with prior art methods and compositions.

It should be noted that, when employed in the present disclosure, the terms "comprises," "comprising," and other derivatives from the root term "comprise" are intended to be open-ended terms that specify the presence of any stated features, elements, integers, steps, or components, and are not intended to preclude the presence or addition of one or more other features, elements, integers, steps, components, or groups thereof.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

While it is apparent that the illustrative embodiments of the invention herein disclosed fulfill the objectives stated above, it will be appreciated that numerous modifications and other embodiments may be devised by one of ordinary skill in the art. Accordingly, it will be understood that the appended claims are intended to cover all such modifications and embodiments, which come within the spirit and scope of the present invention.

What is claimed is:

1. A lightweight, composite antiballistic plate assembly comprising interlocking ceramic elements are backed by a ductile backing material that is completely encapsulated in a ductile prepreg material selected from aramid, e-glass, s-glass, and carbon fiber prepregs.

2. The lightweight composite antiballistic plate assembly of claim 1, wherein the ceramic plate comprises a hot-pressed or spark-plasma sintered ceramic fortified with nanomaterials.

3. The lightweight composite antiballistic plate assembly of claim 2, wherein the nanomaterials comprise multi-walled carbon nanotubes.

4. The lightweight composite antiballistic plate assembly of claim 2, wherein the nanomaterials comprise boron nitride (BN) nanotubes.

5. The lightweight composite antiballistic plate assembly of claim 2, wherein the nanomaterials comprise tungsten sulfide (WS2) nanotubes.

6. The lightweight composite antiballistic plate assembly of claim 2, wherein the nanomaterials comprise silicon carbide (SiC) nanotubes.

7. The lightweight composite antiballistic plate assembly of claim 2, wherein the hot-pressed or spark-plasma sintered ceramic comprises more than 90% of boron carbide (B4C), silicon carbide (SiC), aluminum magnesium boride, polycrystalline cubic boron nitride, titanium boride, titanium carbide, tungsten boride, zirconium boride, boron suboxide, calcium hexaboride, alumina, beryllium boride, and mixtures thereof.

8. The lightweight composite antiballistic plate assembly of claim wherein the hot-pressed ceramic is fortified with nanotubes in a concentration in a range of 0.5% to 7.5% w/v.

9. The lightweight composite antiballistic plate assembly of claim 1, wherein the antiballistic plate comprises replaceable and interlocking ceramic modules.

10. The lightweight composite antiballistic plate assembly of claim 9, wherein the replaceable and interlocking ceramic modules comprise osteomorphic blocks.

11. The lightweight composite antiballistic plate assembly of claim 9, wherein the replaceable and interlocking ceramic modules comprise convex blocks.

12. The lightweight composite antiballistic plate assembly of claim 9, wherein the replaceable and interlocking ceramic modules comprise hexagonal plates with interlocking tabs and slots, or with sloping edges that fit into adjacent modules.

13. The lightweight composite antiballistic plate assembly of claim 1, wherein the ceramic elements are backed by a ductile polymer of a selected one of ultra-high molecular weight polyethylene woven fiber, aramid woven fiber, and polybenzoxazole (PBO) woven fiber.

14. The lightweight composite antiballistic plate assembly of claim 1, wherein the ceramic elements are backed by a ductile metal selected from one of magnesium, aluminum, steel, iron, nickel, titanium, beryllium, zirconium, and alloys based upon the above metals.

15. A lightweight composite antiballistic plate assembly comprising interlocking ceramic elements that are completely encapsulated in a ductile prepreg material selected from aramid, e-glass, s-glass, and carbon fiber prepregs and that are backed by ductile backing material that is completely encapsulated in a ductile prepreg material selected from aramid, e-glass, s-glass, and carbon fiber prepregs.

16. The lightweight composite antiballistic plate assembly of claim 1, wherein the ceramic elements are coated in a shock-resistant or abrasion-resistant material comprising a selected one or more of polyurethane, polyurea, natural and synthetic rubbers, and natural and synthetic foams.

17. The lightweight composite antiballistic plate assembly of claim 1, wherein the ceramic elements have a nonplanar strike face to more efficiently defeat ballistic projectiles that were directed from the frontal direction.

* * * * *